United States Patent [19]

Barlow et al.

[11] 4,346,889

[45] Aug. 31, 1982

[54] BOARD GAME WITH PATH CREATING TILES FOR VEHICLE

[75] Inventors: Gordon A. Barlow; John R. Krutsch, both of Glenview, Ill.

[73] Assignee: Gordon Barlow Design, Skokie, Ill.

[21] Appl. No.: 230,615

[22] Filed: Feb. 2, 1981

[51] Int. Cl.[3] ..... A63F 9/00; A63F 9/06

[52] U.S. Cl. ..... 273/1 GA; 273/153 S; 273/284; 46/259

[58] Field of Search ..... 46/202, 259; 273/108, 273/109, 153 S, 1 GA, 1 GB, 1 GE, 86 B, 284

[56] References Cited

U.S. PATENT DOCUMENTS

| | | | |
|---|---|---|---|
| 3,074,200 | 1/1963 | Ziegenfuss | 46/202 X |
| 3,402,503 | 9/1968 | Glass et al. | 273/86 B X |
| 3,414,194 | 12/1968 | Seitzinger | 273/86 B X |
| 3,494,617 | 2/1970 | Glass et al. | 273/1 GE |
| 3,690,031 | 12/1972 | Shinoda | 46/202 X |

*Primary Examiner*—Richard C. Pinkham
*Assistant Examiner*—Scott L. Brown
*Attorney, Agent, or Firm*—Kinzer, Plyer, Dorn & McEachran

[57] ABSTRACT

A board game including a number of generally similar rectangular tiles slidable relative to one another on a base to form a rectangular pattern with at least one vacant space equal in size to a tile. At least one groove is formed in the top surface of some of the tiles and more than one groove is formed in the top surfaces of others of the tiles with each groove extending from one side edge of a tile to another side edge of a tile. All grooves intersect the side edges of its tile at the midpoint of each side edge so that continuous paths can be formed on adjacent tiles if each adjacent tile has a groove extending to its side edges that is contiguous to an adjacent tile. Discontinuous paths are formed if one of the tiles does not have a groove extending to its side edge that is contiguous with an adjacent tile. A self-propelled vehicle is provided to move across the tiles. The vehicle has a guide which rides in the groove to direct the vehicle across the tile. An alarm is carried by the vehicle and the alarm is arranged to sound when the vehicle reaches the side edge of a tile.

5 Claims, 8 Drawing Figures

Fig. 1.
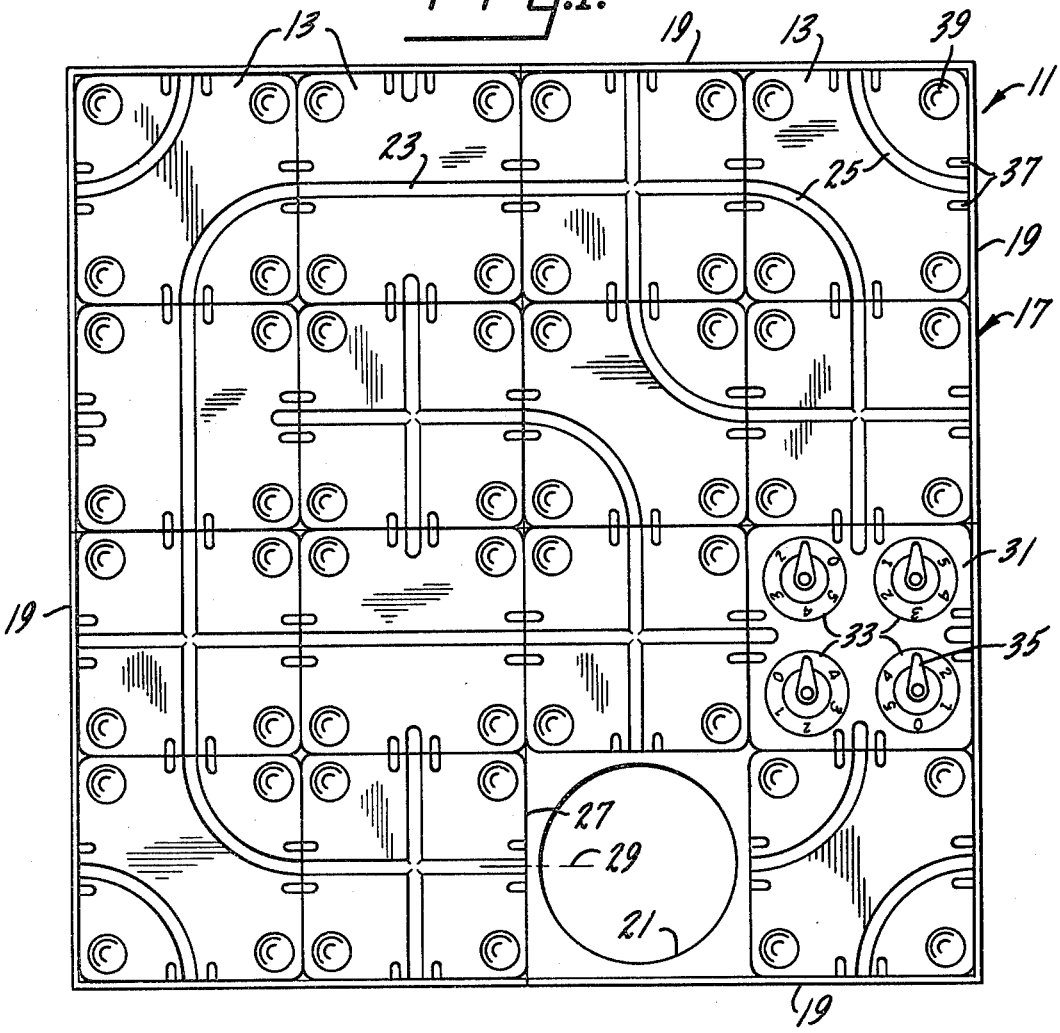
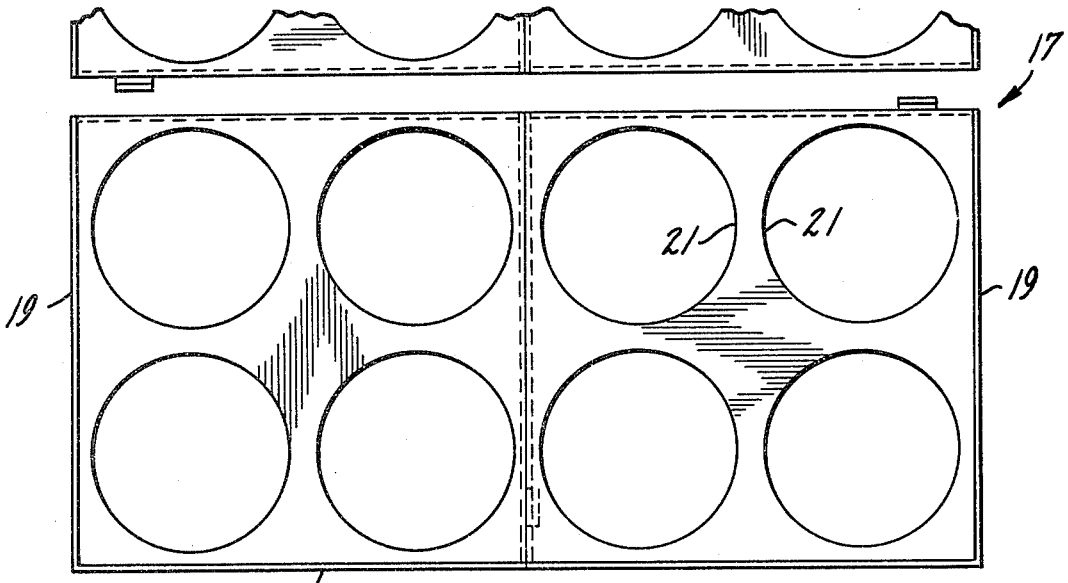
Fig. 2.

fig.3.
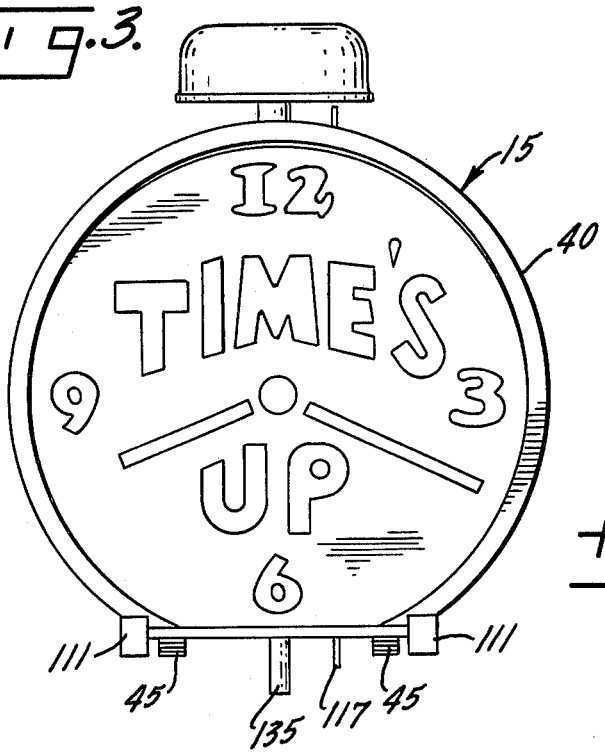
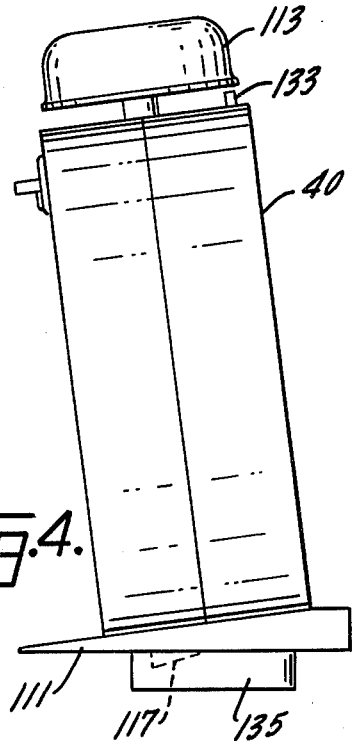
fig.4.
fig.5.
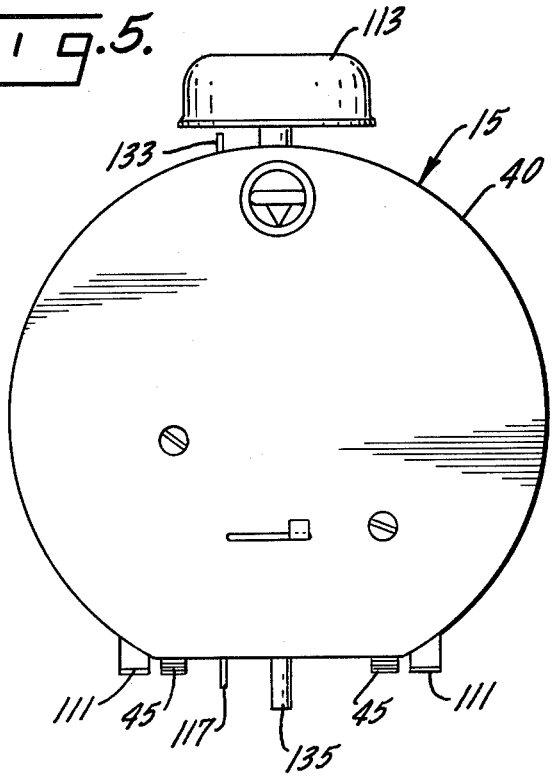
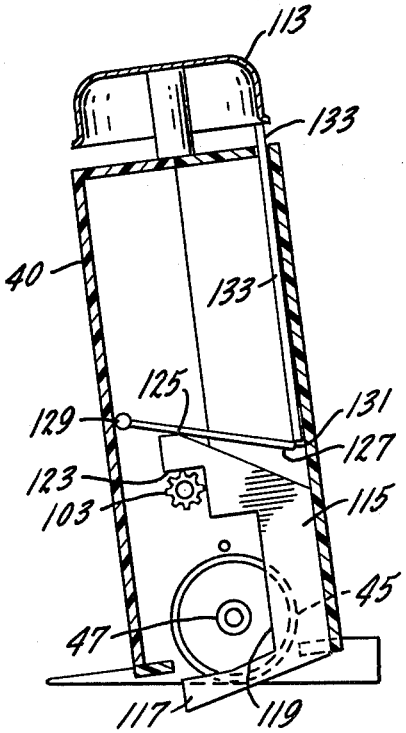
fig.8.

BOARD GAME WITH PATH CREATING TILES FOR VEHICLE

SUMMARY OF THE INVENTION

This invention is concerned with a board game which can be played by two, three or four players and utilizes tiles which can be moved by the players with the objective of providing a continuous path of travel for a self-propelled vehicle moving upon the tiles.

The tiles provide a track for the self-propelled vehicle made up of a groove in each piece of tile. Some tiles have only straight grooves. Others have only curved grooves while some tiles have cross grooves. In turn, each player must move the tiles to provide a continuous track for the vehicle. The manipulation of the tiles must be accomplished while the vehicle is moving across a tile. The self-propelled vehicle sounds an alarm when it reaches the edge of a tile which alarm ends as the vehicle starts moving across the next tile, assuming of course, that the grooves are of adjacent tiles are properly aligned so that the vehicle can continue movement.

The self-propelled vehicle can be moved at either a low or a high speed depending on the ability of the players.

Other purposes and uses of the invention will be found in the following specification and drawings.

BRIEF DESCRIPTION OF THE DRAWINGS

The invention is illustrated more or less diagrammatically in the following drawings wherein:

FIG. 1 is a top plan view of the game board of this invention;

FIG. 2 is a partial top plan view of the base of the game board of this invention showing the sections formed in the base detached from one another;

FIG. 3 is an enlarged front plan view of the self-propelled vehicle of this invention;

FIG. 4 is a side elevational view of the vehicle of FIG. 3;

FIG. 5 is a rear elevational view of the vehicle of FIG. 3;

FIG. 8 is a reduced scale view taken along line 8—8 of FIG. 6.

DESCRIPTION OF THE PREFERRED EMBODIMENT

Figure 7:
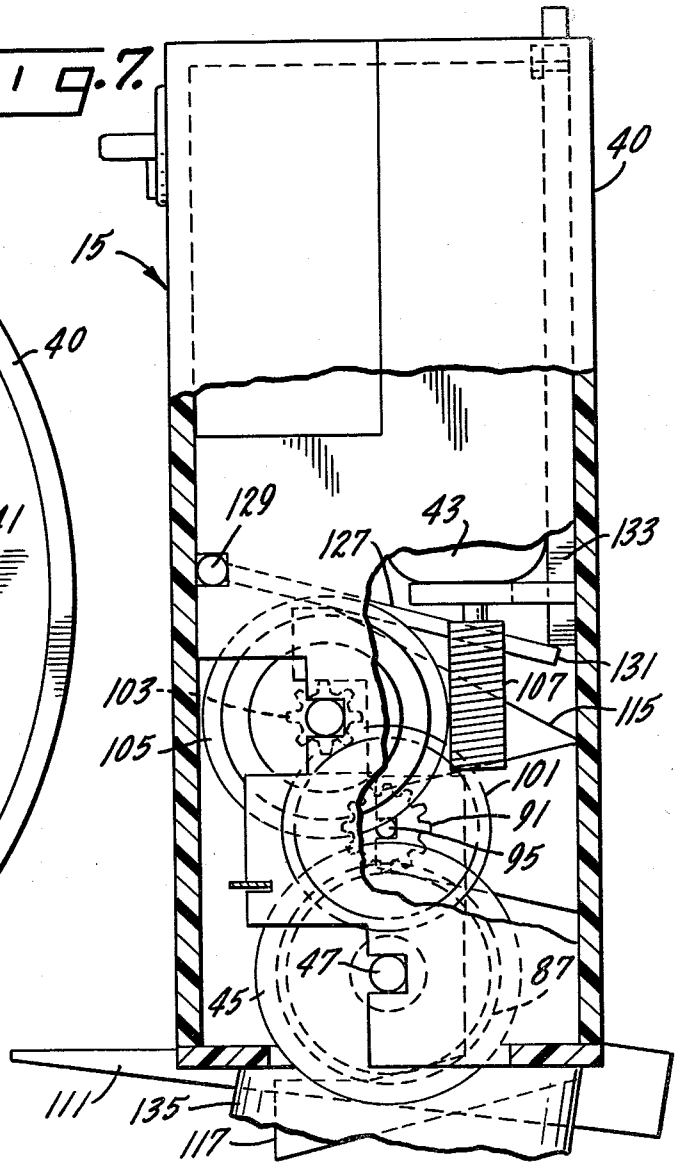
FIG. 7 is a side elevational view of the vehicle with portions broken away for clarity of illustration.
Figure 6:
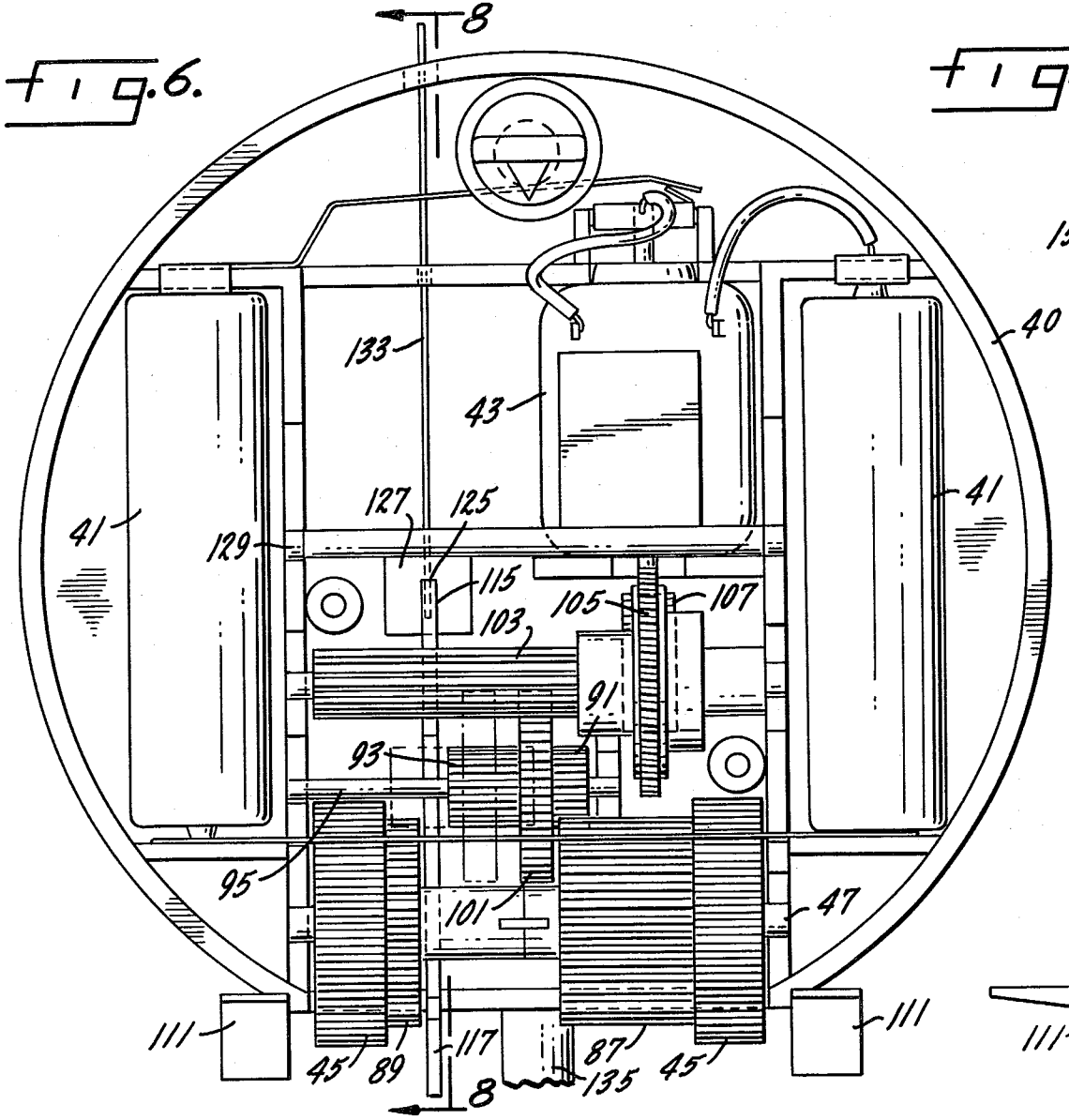
FIG. 6 is an enlarged rear elevational view of the vehicle with the back of the vehicle removed and some parts broken away for clarity.

The board game 11 of this invention is shown in FIG. 1 of the drawings. It includes tiles 13, a self-propelled vehicle 15 in the shape of an old-fashioned alarm clock and a base 17 on which the tiles are supported for sliding movement. The base 17 is surrounded by four peripherhal walls 19 which retain the tiles 13 on the base. To reduce the weight of the base and to reduce cost by using a minimal amount of plastic in forming the base, circular openings 21, each of which is smaller than a tile, are formed in the base.

In this embodiment of the invention, fifteen tiles are provided with each tile being formed in the shape of a square. The base is also in the form of a square sufficiently large to hold sixteen tiles. For ease of manufacture, the base may be formed in sections, preferably four sections, which snap fasten to one another by means of fasteners 22. Straight grooves 23 are formed in some of the tiles and curved grooves 25 are formed in other tiles. Each groove, whether straight or curved, intersects a side edge 27 of its tile at the midpoint 29 thereof.

In one embodiment of the invention, fourteen of the fifteen tiles are provided with grooves. Three of these tiles have a single straight groove 23. Six of the tiles have two straight grooves 23 which extend at right angles to each other to form a cross on the tile and five have a pair of curved grooves 25 which grooves open towards opposite corner edges of the tile and do not intersect. The fifteenth tile is a scoring tile 31 which has four dials 33 formed thereon with numbers 0 to 5 marked around each dial. Each dial is also equipped with a pointer 35 for indicating the selected number.

A pair of recesses 37 are located on opposite sides of each groove adjacent the intersection of the groove with the side edge of the tile. Opposite ends of each recess are sloped or rounded. Depressions 39 are formed in each corner of a tile to aid in sliding the tile over the base 17.

The self-propelled vehicle 15, which includes a housing 40 molded to have the appearance of an old-fashioned alarm clock, contains one or more batteries 41 which power a motor 43. The batteries are each $1\frac{1}{2}$ volts of the conventional AA type. The motor propels the vehicle through drive wheels 45 which engage the tiles 13. The drive wheels are mounted on an axle 47 to which are affixed gear wheels 87 and 89. Spur gear 91 is engageable with gear wheel 87 for low speed operation and spur gear 93 is engageable with gear wheel 89 for high speed operation. A gear 101 is affixed to slidable drive shaft 95. A level 102 for sliding the shaft extends out the rear of the vehicle housing 40. Gear 101 engages a splined shaft 103 having a sprocket gear 105 mounted thereon. Gear 105 is driven by a worm gear 107 driven by the electric motor 43.

Tapered skids 111 are located on the vehicle housing 40 outward sides of the drive wheels 45. The skids are tapered from the front face of the vehicle housing 40 to the rear to tilt the vehicle housing rearwardly approximately 5° to 10° from the vertical.

An alarm bell 113 is mounted on the top of the clock-like vehicle housing 40. This bell is rung by rotation of the splined shaft 103 when the bell actuator 115 drops into a recess 37 in a tile. The bell actuator 115 is an elongated thin plate of irregular cross-section which is mounted for vertical movement in the housing 40 between the vehicle drive wheels 45. It includes a rearwardly extending and downwardly inclined foot 117 which rides on the tiles 13 and drops into the recesses 37 formed in the tiles. The bell actuator is notched above the foot 117 to provide a recess 119 which receives the vehicle axle 47. Another notch is formed in the actuator to provide a wall 123 which engages the splined shaft 103 when the actuator drops into a recess. The engagement of the rotating splined shaft 103 with the wall 123 forces the top edge 125 of the actuator against a pivotally mounted arm 127 at a location near its pivot 129. The outer end 131 of the arm engages and supports a vertically slideably mounted plunger 133, preferably formed of metal, which is lifted into contact with the bell 113. Rapid vertical reciprocal movement of the plunger 133 rings the bell.

A vertical guide 135 is attached to the housing 40 at the bottom thereof and is positioned to ride in the grooves 23 and 25 formed in the tiles 13. The guide has a horizontal cross-sectional shape somewhat like that of a dumbbell with wider portions at the front and rear tapering to a narrower center section. This permits the guide to follow the curved grooves 25 without disengagement.

Energization of the electric motor 43 is accomplished by rotation of a switch 137 which rams a moveable contact 139 into engagement with a fixed contact 141 to complete the circuit between the batteries 41 and the electric motor.

The board game 11 of this invention may be played by two to four players. The tiles 13 are arranged in any manner on the base 17 with one space being free of a tile. Each player is assigned one of the dials 33 and the pointer 35 on each dial used by a player is set to the number 5. One of the players is selected by lot or otherwise to begin the game. The vehicle 15 is placed on a randomly selected tile at the edge thereof with its guide member 135 located in either a straight groove 23 or a curved groove 25 depending on the particular tile on which the vehicle is placed. With the vehicle at the edge of the tile, the inclined foot 117 of the bell actuator 115 will be located in a recess 37 and consequently the bell 113 will be ringing. The vehicle 15 is started moving forward with the face of the clock-like vehicle considered as its front.

The player selected to start the game must now slide the tiles 13 on the base 177 so that a continuous grooved path is formed for the vehicle. This means that at least the tile adjoining the tile on which the vehicle is moving must have a groove aligned with the groove in which the guide member 135 of the vehicle 15 is located. The player can slide any number of tiles but he must complete the path before the vehicle reaches the opposite side of the tile on which it is moving. When it reaches this opposite side, the bell actuator 115 will drop into one of the recesses 37 located adjacent the groove, sounding the bell.

If the bell rings before a groove alignment is made in the next contiguous tile, then the player loses the game and subtracts one point from his score by moving his pointer 35 on his dial 33 to the next lower number. If a tile 13 with a groove which matches the groove on the tile on which the vehicle is operating is properly positioned, then the next player in order takes his turn moving tiles to continue the path when it moves across the next tile. The game can be played until one or more players have reduced their scores to zero.

We claim:

1. A board game including:

a plurality of generally similar rectangular tiles slidable relative to one another to form a rectangular pattern with one vacant space equal in size to a tile, at least one groove formed in the top surface of some of said tiles and more than one groove formed in the top surface of other of said tiles with each groove extending from one side edge of a tile to another side edge of a tile with all grooves intersecting the side edges of its tile at the midpoint of each side edge so that continuous paths can be formed on adjacent tiles if each adjacent tile has a groove extending to its side edges that is contiguous to an adjacent tile or discontinuous paths can be formed if one of the tiles does not have a groove extending to its side edge that is contiguous with an adjacent tile, a self-propelled vehicle adapted to move across the tiles, said vehicle having guide means which ride in the grooves to steer the vehicle across the tiles, an alarm carried by said vehicle, and means to sound the alarm when the vehicle reaches the side edge of a tile.

2. The board game of claim 1 in which the one groove formed in the top surface of some of said tiles extends from the midpoint of one side edge to the midpoint of the opposite side edge of said tile.

3. The board game of claim 1 in which a pair of grooves extending at right angles to each other are formed in other of said tiles and each groove extends from one side edge to an opposite side edge of said tile.

4. The board game of claim 1 in which a pair of non-intersecting curved grooves are formed in other of said tile with each groove extending from a side edge to an adjacent side edge of a tile.

5. The board game of claim 1 in which said means to sound the alarm includes at least one recess formed in the top surface of each tile with said recess being positioned adjacent the inner section of a groove in said tile with a side edge thereof and an alarm operating lever carried by said self-propelled vehicle which lever drops into said recess to operate the alarm when the vehicle reaches the recess and is lifted out of the recess by engagement with the top surface of the tile to shut off the alarm when the vehicle moves away from the recess.

* * * * *